US009117361B1

(12) United States Patent
Hennigan et al.

(10) Patent No.: US 9,117,361 B1
(45) Date of Patent: Aug. 25, 2015

(54) HAND SANITIZER MONITOR

(71) Applicants: Stephen Hennigan, Fayetteville, AR (US); David Ratz, Cincinnati, OH (US)

(72) Inventors: Stephen Hennigan, Fayetteville, AR (US); David Ratz, Cincinnati, OH (US)

( * ) Notice: Subject to any disclaimer, the term of this patent is extended or adjusted under 35 U.S.C. 154(b) by 0 days.

(21) Appl. No.: 14/215,741

(22) Filed: Mar. 17, 2014

(51) Int. Cl.
*G08B 23/00* (2006.01)
*G08B 21/24* (2006.01)

(52) U.S. Cl.
CPC ..... *G08B 21/245* (2013.01)

(58) Field of Classification Search
CPC ..... G08B 21/245; G08B 23/00
USPC ..... 340/573.1, 541, 506, 545.3, 561, 565
See application file for complete search history.

(56) References Cited

U.S. PATENT DOCUMENTS

| | | | | |
|---|---|---|---|---|
| 6,727,818 | B1 | 4/2004 | Wildman et al. | 340/573.1 |
| 7,893,842 | B2 | 2/2011 | Deutsch | 340/573.1 |
| 8,164,439 | B2 | 4/2012 | Dempsey et al. | 340/539.12 |
| 8,294,585 | B2 | 10/2012 | Barnhill | 340/573.1 |
| 8,377,229 | B2 | 2/2013 | Barnhill et al. | 134/56 |
| 8,395,515 | B2 | 3/2013 | Tokhtuev et al. | 340/603 |
| 8,400,309 | B2 | 3/2013 | Glenn et al. | 340/573.1 |
| 8,598,996 | B2 | 12/2013 | Wildman et al. | 340/286.09 |
| 2013/0099929 | A1* | 4/2013 | Ophardt et al. | 340/573.1 |
| 2015/0022361 | A1* | 1/2015 | Gaisser et al. | 340/573.1 |

* cited by examiner

*Primary Examiner* — Toan N Pham
(74) *Attorney, Agent, or Firm* — Kiesling & Pieper PLC; David B. Pieper

(57) ABSTRACT

A hand sanitizer unit for use with a pump bottle using a user activated dispensing pump with a main body housing an electronic circuit and defining a sensor aperture for use with two passive infrared sensors separated by a mechanical lens baffle to detect movement and direction of the movement. The unit also includes a pump sensor positioned to detect dispensing or lack thereof of a hand sanitizer to sound an alarm when motion is detected and the pump sensor does not detect activation of the user activated dispensing pump. Further items include a mute control switch, communication system, and a direction of motion switch connected to the microprocessor. The programming flow and method of operation of the unit are also disclosed.

4 Claims, 11 Drawing Sheets

HAND SANITIZER MONITOR

CROSS-REFERENCE TO RELATED APPLICATIONS

This application claims priority to and is a continuation-in-part of U.S. Patent Application Ser. No. 61/790,454, filed on Mar. 15, 2013 entitled Hand Sanitizer which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in monitoring dispensers for hand sanitizing liquids. More particularly, the invention relates to improvements particularly suited for ensuring hand sanitizer liquid use when entering and exiting spaces. In particular, the present invention relates specifically to a directional motion sensing unit with hand pump transducer and alert for registering hand sanitizing.

2. Description of the Known Art

As will be appreciated by those skilled in the art, hand sanitizing monitors are known in various forms. Patents disclosing information relevant to hand sanitizers, dispensing, and monitoring equipment include: U.S. Pat. No. 6,727,818, issued to Wildman, et al. on Apr. 27, 2004, entitled Hygiene monitoring system; U.S. Pat. No. 7,893,842, issued to Deutsch on February 22, entitled Systems and methods for monitoring health care workers and patients; U.S. Pat. No. 8,164,439, issued to Dempsey, et al. on April 24, entitled Ultrasonic compliance zone system; U.S. Pat. No. 8,294,585, issued to Barnhill on October 23, entitled Complete hand care; U.S. Pat. No. 8,377,229, issued to Barnhill, et al. on February 19, entitled Ingress/egress system for hygiene compliance; U.S. Pat. No. 8,395,515, issued to Tokhtuev, et al. on March 12, entitled Hand hygiene compliance monitoring; U.S. Pat. No. 8,400,309, issued to Glenn, et al. on Mar. 19, 2013, entitled Hygiene compliance; and U.S. Pat. No. 8,598,996, issued to Wildman, et al. on Dec. 3, 2013, entitled Hygiene compliance reporting system. Each of these patents is hereby expressly incorporated by reference in their entirety.

From these prior references it may be seen that these prior art patents are very limited in their teaching and utilization, and an improved hand sanitizer monitor is needed to overcome these limitations.

SUMMARY OF THE INVENTION

The present invention is directed to an improved hand sanitizer monitor using passive infrared sensors with a baffle lens and access aperture to create a window for detecting movement along with a pump sensor for detecting use of a sanitizing element and an alarm and mute system for reminders to use the sanitizer. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
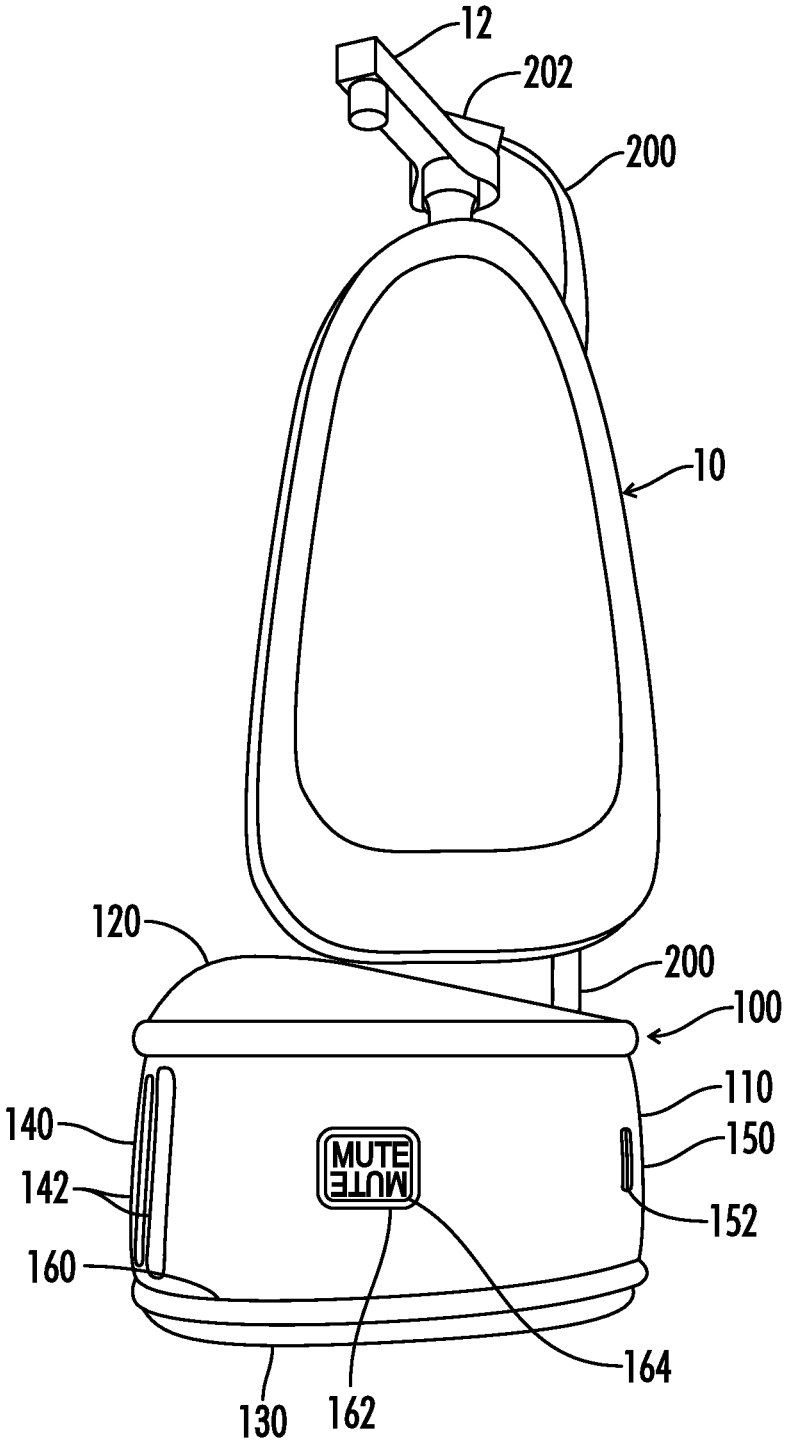
FIG. 1 is a perspective view of a hand sanitizer monitor.
Figure 2:
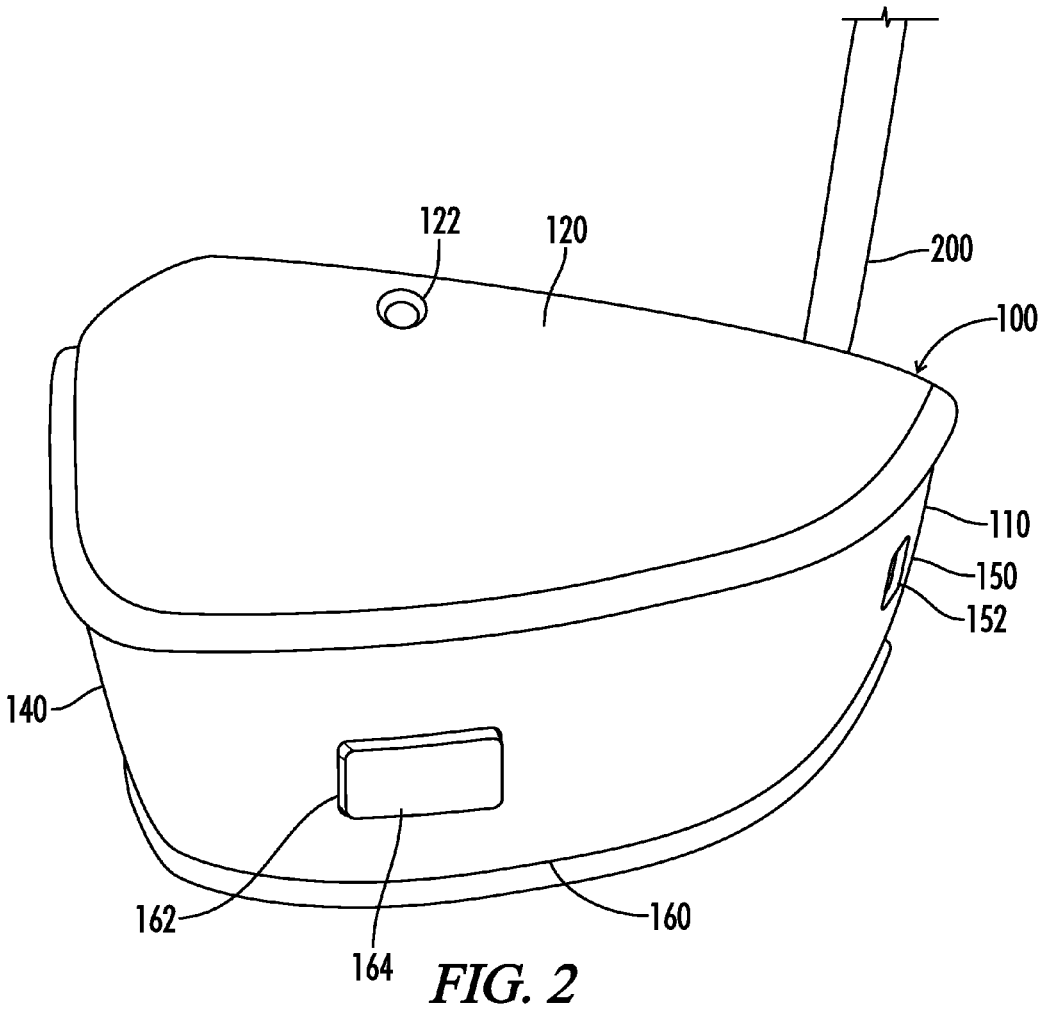
FIG. 2 is a top view of a hand sanitizer monitor.
Figure 3:
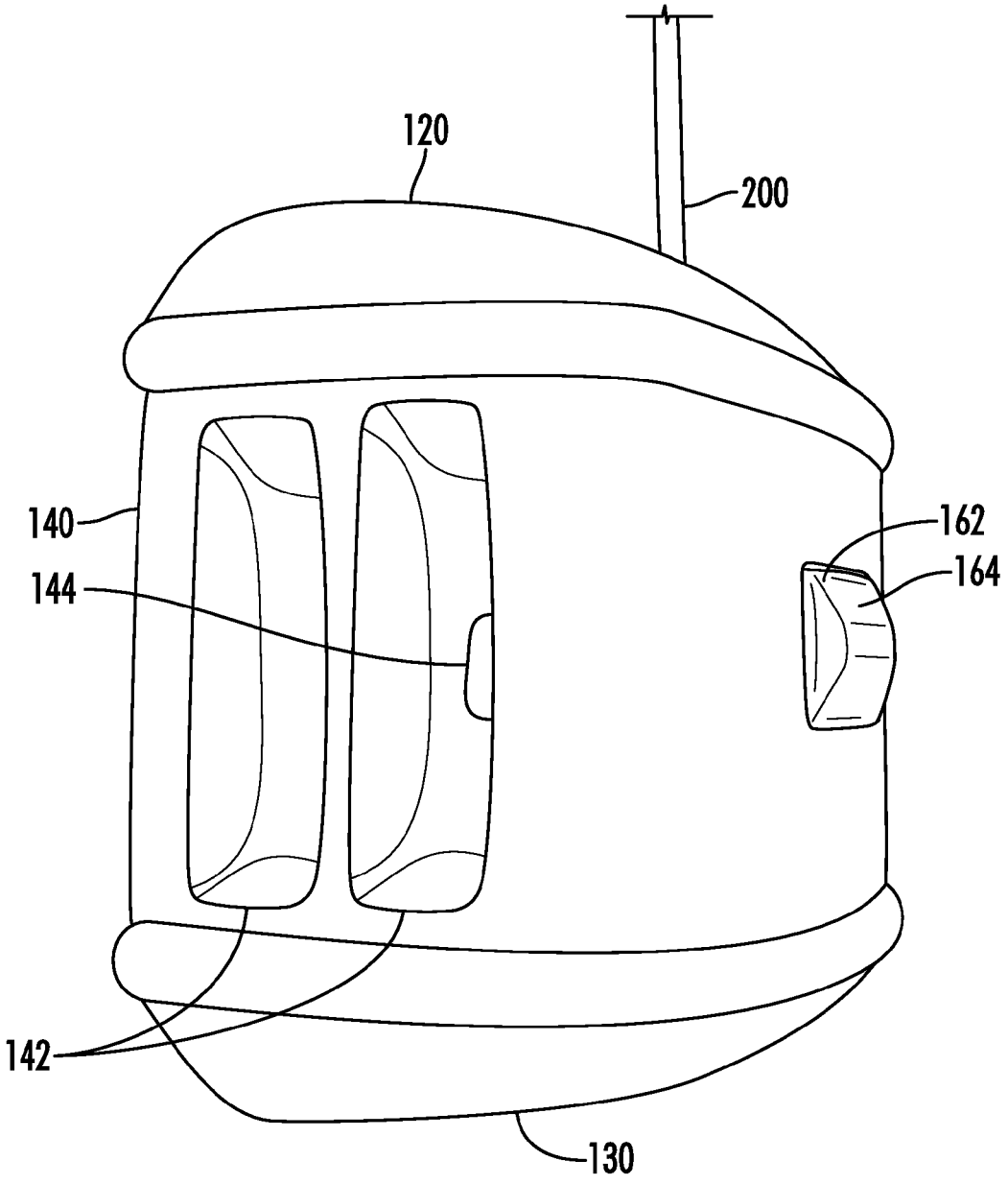
FIG. 3 is a left side view of a hand sanitizer monitor.
Figure 4:
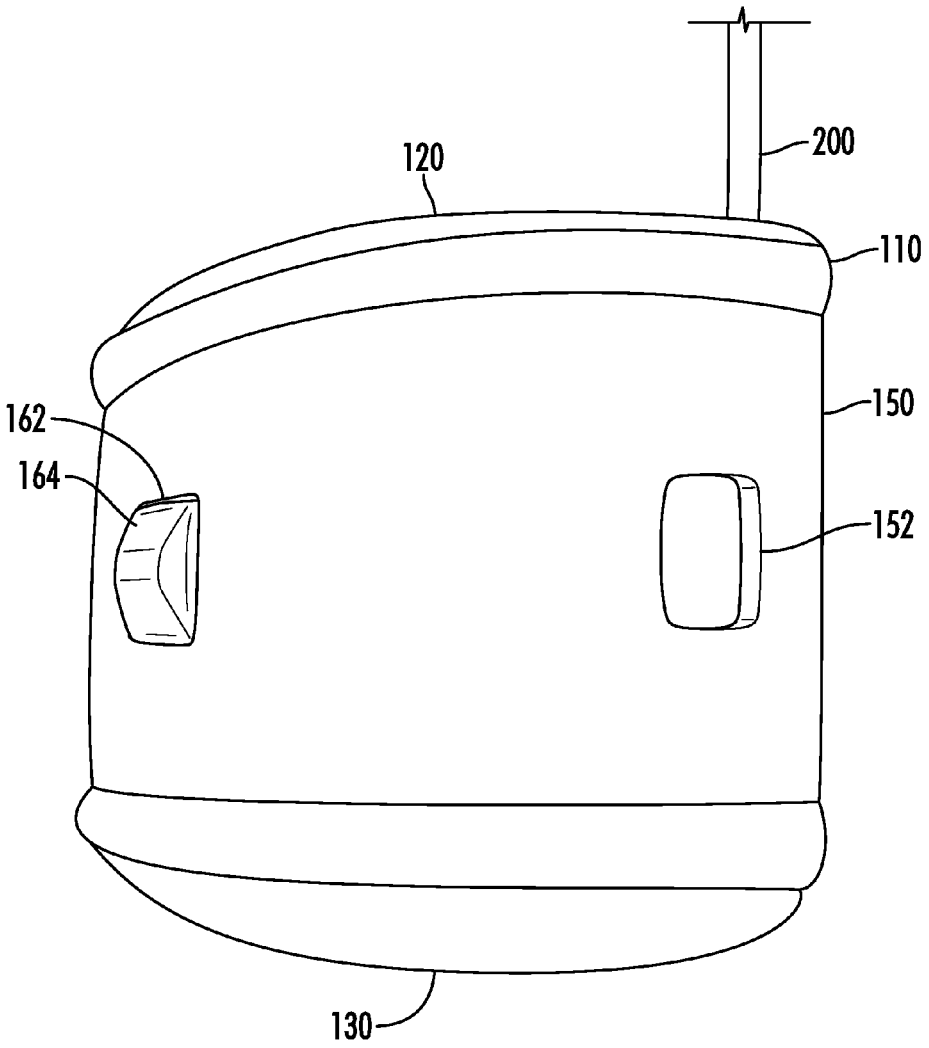
FIG. 4 is a right side view of a hand sanitizer monitor.
Figure 5:
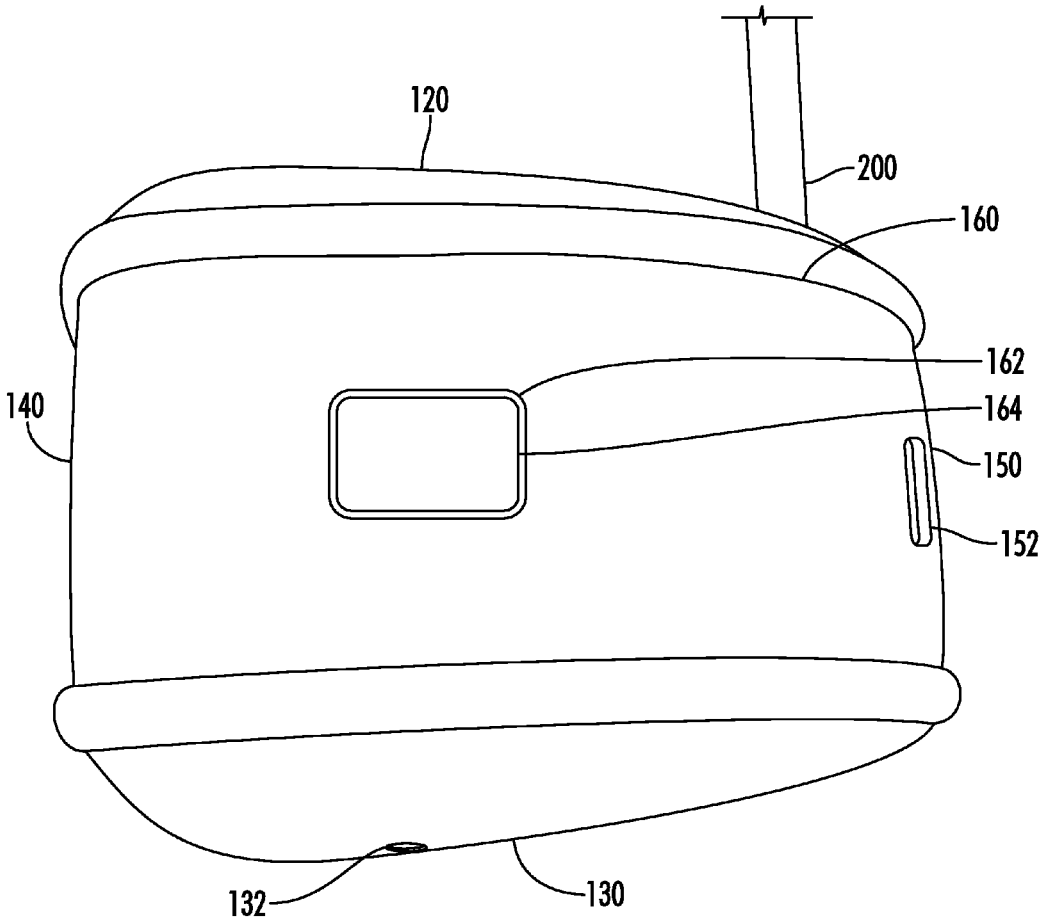
FIG. 5 is a front view of a hand sanitizer monitor.
Figure 6:
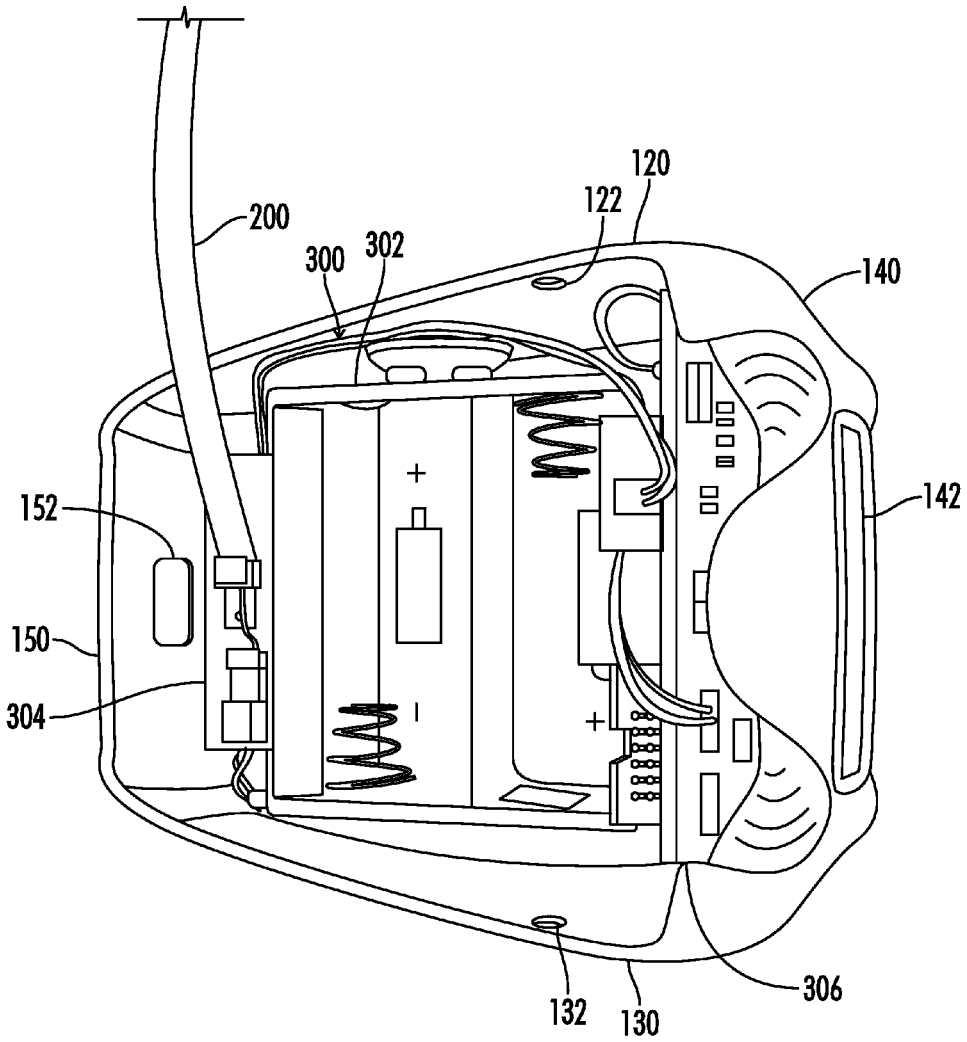
FIG. 6 is a back view of a hand sanitizer monitor.

As shown in FIGS. 1 through 6 of the drawings, one exemplary embodiment of the present invention is generally shown as a hand sanitizer unit 100 for use with a pump bottle 10 having a user activated dispensing pump 12. The hand sanitizer unit 100 is constructed with a main body 110. The main body includes a top 120, bottom 130, left side 140, right side 150, front 160, and back 170. These reference descriptions are being used for describing the item as shown in the drawings, but obviously may change descriptions with a different orientation. The top 120 includes a top mounting aperture 122 and similarly, the bottom 130 also includes a bottom mounting aperture 132 so that screws may be used to secure the unit to a wall, door, or other appropriate mounting location. The left side 140 includes a sensor recess 142 with a sensor aperture 144 used to allow the electrical circuit sensors to detect movement. The right side 150 includes a communications aperture 152 to allow for the unit to be permanently wired into a larger system. The front 160 includes a button aperture 162 which issued in this embodiment to mount a mute button 164. The back 170 defines a hollowed out circuit aperture 172 for mounting the electrical components. A pump sensor cord 200 is used to connect the internal electrical components to the pump sensor 202 that is placed on top of the pump to be used as either a touch or pressure sensor. FIG. 6 shows the electrical circuitry 300 including a power source shown as a battery pack 302 and the circuitry including a pump circuit board 304 electrically connected to a communication and detection circuit board 306.

The general operation of the unit 100 is designed to detect a person(s) entering a room weather mounted either inside or outside of the room. The preferred setup is for the unit to be mounted inside of the room to be monitored. This will reduce the possible errors. When a person enters or leaves a room an alarm is triggered as a method to encourage and/or remind the person to sanitize their hands when both entering and leaving a room. The alarm can be prevented or silenced by using the sanitizer, such as pushing the "PUMP" before or after triggering the alarm, or pushing the "MUTE" button before or after entering/leaving a room, the alarm will also time-out after a preset delay to prevent it from becoming a nuisance. The total number of people moving through the doorway, button pushes and all alarms are recorded to allow for later retrieval and analysis on sanitizing compliance levels and the amount of traffic going in and out of the particular room. Additionally, alarms can be disabled to allow the activity and compliance to be recorded without any feedback so a base line of compliance can be established or tracked.

Figure 7:
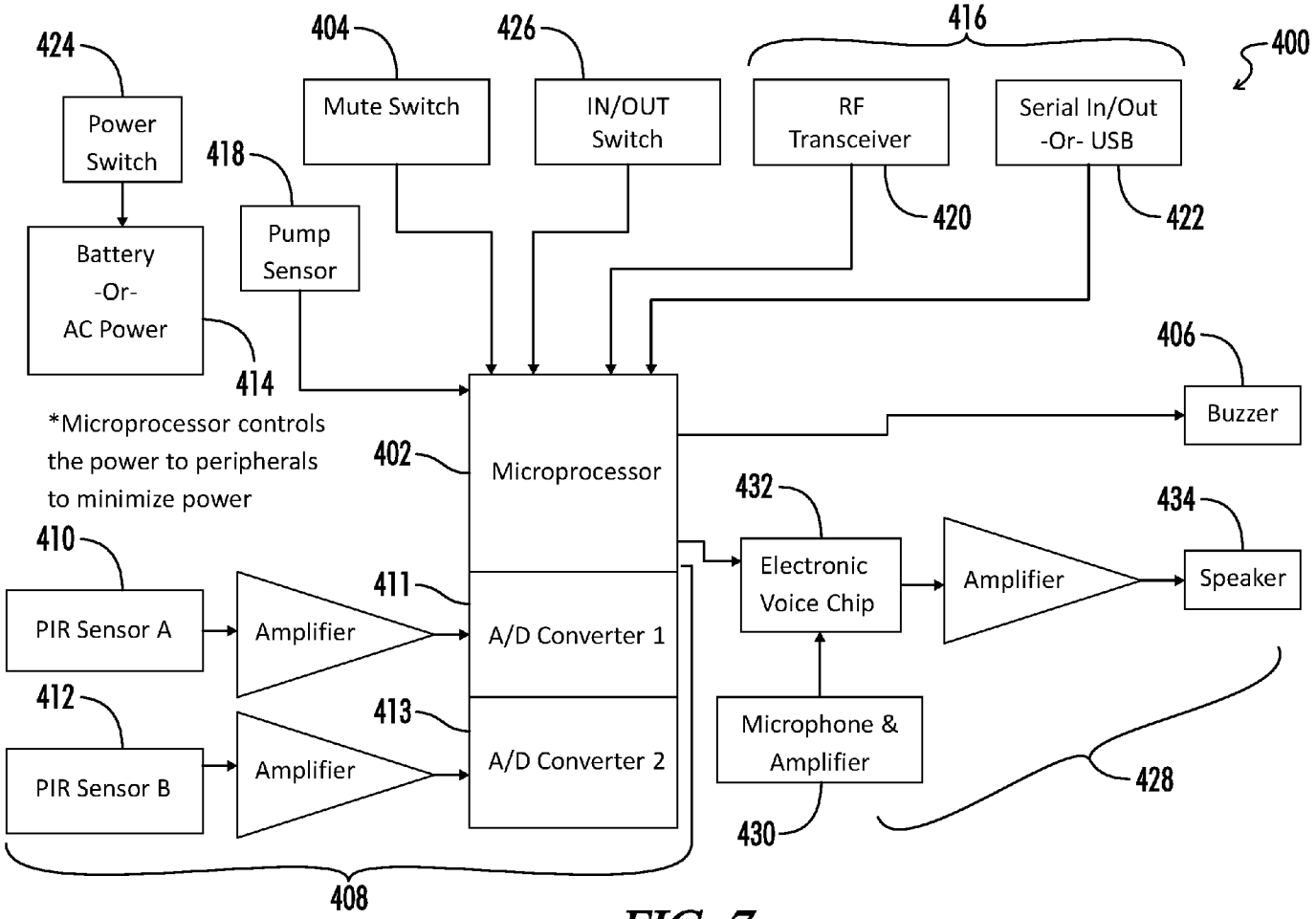
FIG. 7 is a schematic diagram of a hand sanitizer monitor electrical circuit.

FIG. 7 shows a basic circuit schematic 400 including the core microprocessor 402 electrically connected to a mute control switch 404, alarm 406, motion sensor 408 with first infrared sensor 410 and First AD converter 411 and second infrared sensor 412 with second infrared sensor 412, power supply 414, communication port 416, pump sensor 418, RF transceiver 420, serial port 422, power switch 424, in/out direction of motion switch 426, communication system 428, microphone input 430, voice chip 432, and speaker 434.

The in/out direction of motion switch 426 on the unit is used to select 'IN' for being mounted inside the room and 'OUT' when the unit is mounted outside the room. The selection changes some alarm delays to enable the system to operate more effectively. An example would be the length of time the system waits to trigger an audible alarm if the target does not sanitize their hands. When walking into the room that delay is much longer while the delay when leaving is very short to prevent the audible alarm from triggering after the subject is halfway down the hall. This setting also effects the data logging so both entering and exiting compliance can be individually tracked.

When a subject walks past both sensors 410, 412 in the unit's field of view an alarm event will be initiated and a timer is started. If the target pushes the pump 418 or the MUTE button 404 the alarm 406 will not sound and will be disabled for a short delay depending on whether the pump was pushed or the "MUTE" button 404 was pushed. After this short delay the unit re-arms itself for the next subject. The subject can also sanitize their hands before triggering the alarm and that will start a short delay that will allow the target to enter or exit a room without alarming. In other words, if a person sanitizes their hands prior to entering or leaving the room the unit will consider that compliance and not alarm. This allows the system to operate and not rely on a person passing through the doorway before they can sanitize their hands. This is to allow operation with the minimum amount of disturbance or behavior modification other than the sanitizing.

Data is logged on all events and can be retrieved by a serial, parallel, optical or wireless communication system connection(s) 428 to the unit 100. Any one or combination of these methods may easily be employed depending on customer need. The unit saves the statistical data to non-volatile memory each time the "MUTE" button 404 is pushed, every 12 hours or if the battery voltage drops below the preset threshold value.

The unit 100 uses a power supply 414 that can be battery operated, powered by a "wall-wart" similar to a phone charger or directly from 110/220 VAC depending on customer need.

Rapid pushing of the "PUMP" button 418 will be used to signal the system that the sanitizer reservoir is empty or very close to empty. This rapid pumping will be counted as a single event to get adequate sanitizer out of the bottle. This will show how many people attempt to sanitize their hands when the reservoir is empty. The data could also be used to show which locations require more frequent refills.

Figure 8:
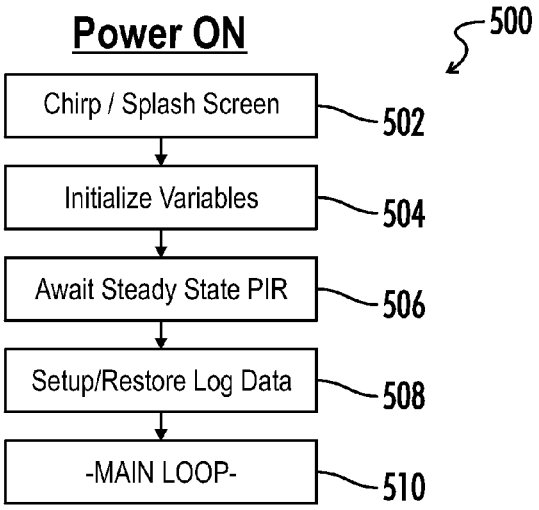
FIG. 8 is a flow chart representation of a power on flow chart.

FIG. 8 shows the power on flow chart 500. The power on flow chart 500 begins with an initial chirp 502 and then initializes variables 504, awaits steady state 506, initializes log data 508, and finally enters the main loop 510. The initial audible chirp 502 tells the user that the system is on and powered. Initializing variables 504 sets the initial startup values. The system then waits 506 for the sensor to settle into a steady state PIR before enabling the alarm function. This waiting could also be done with a simple time delay. The system then initializes log data 508 such as resetting counters, running averages and items not in non volatile memory an filling running average array, setup log data and restore statistical data values.

Figure 9:
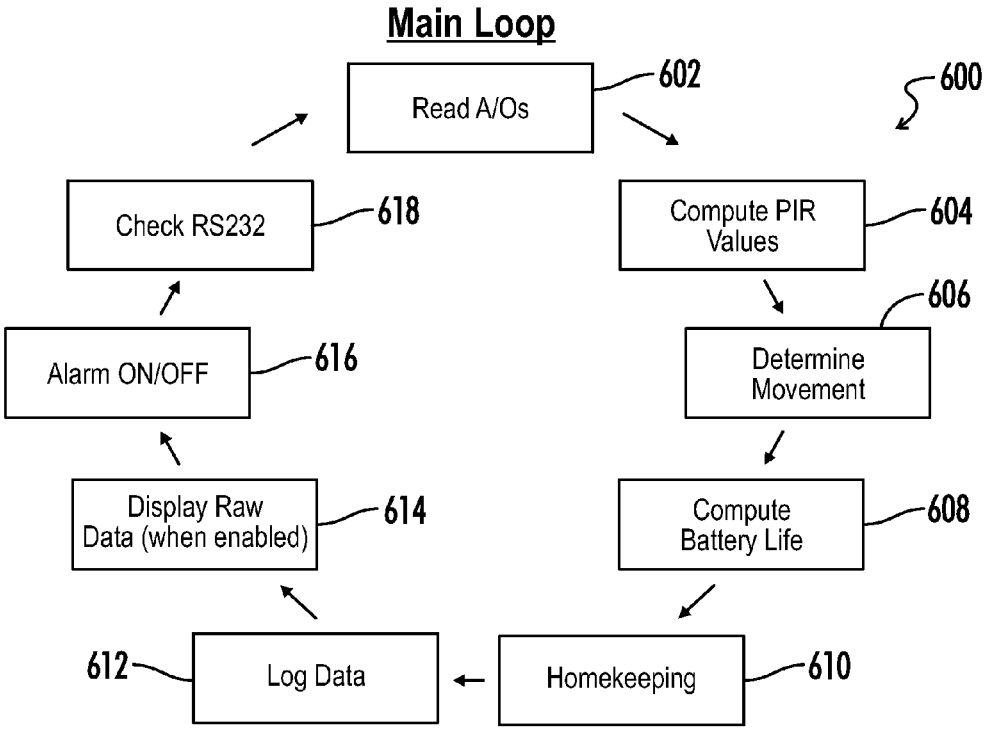
FIG. 9 is a flow chart representation of a main flow loop.

FIG. 9 shows the main loop 600 that begins with reading the analog to digital converters 602, computing the passive infra red PIR value 604, determine movement 606, compute battery life 608, housekeeping 610, log data 612, display data 614, alarm on off 616, and check serial port 618 before returning to start the loop again.

Reading the analog to digital converters 602 consists of reading both analog to digital converters for two infrared sensors.

Computing the passive infra red PIR value 604 includes inserting the PIR voltages into a running average array to get a time period of information associated with changing voltages.

Determining movement 606 involves looking at the array to determine if the threshold voltage is met to detect motion and then looking at direction of voltage change from each PIR to confirm motion and also checking the time between the thresholds to verify door entry/exit and set/clear the motion flags.

Computing the battery life 608 counts the alarms and/or reads battery voltages or count events to determine the remaining battery life and saves the relevant data if the computed battery life is low to give audible feedback for low battery condition such as a timed short chirp output.

Housekeeping 610 is a general catch all such as checking the direction switch and logging the switch position and erasing, modify or download data log via a universal asynchronous receiver/transmitter UART, or check an auxiliary connector such as a serial port such as an RS232 port if applicable.

The log data 612 step simply check to see which data is tracked and saves the data on a new event if enabled. This routine will also set a flag if the alarm memory is full, and can overwrite or stop logging data depending on an auxiliary connector setting. The system logs the following data:

Number of MUTE button pushes
Number of PUMP pushes
How many walk IN and pump before alarm
How many walk OUT and pump before alarm
How many walk IN and do not sanitize
How many walk OUT and do not sanitize
Percentage of compliance walking IN
Percentage of compliance walking OUT The display data 614 routine is used to display raw data so that one can use raw data to adjust or dial in response to get an ideal operation. This is mainly used for development, as it is envisioned that the commercial product will not require calibration.

The alarm on off routine 616 check flags and counters to turn the alarm on/off depending on alarm frequency and/or duration of alarm/chirp. Examples of these are a low battery chirp, initialization completed, alarms, and other user notifications.

Check serial port 618 is simply a read of the serial port looking for commands or sending output data for monitoring purposes such as statistical data and control display of raw data and firmware version number verification.

Figure 10:
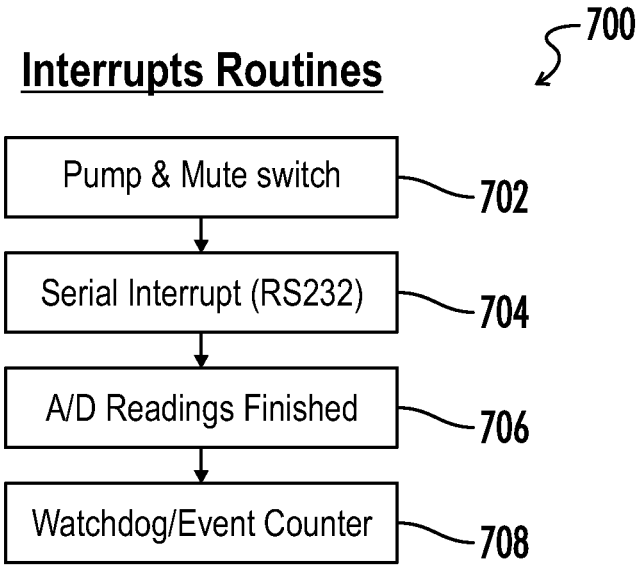
FIG. 10 is a flow chart representation of interrupt routines.

FIG. 10 shows the interrupt routines 700 that are handled upon developing an interrupt to the microprocessor. The interrupt routines 700 include pump or mute interrupt 702, communications interrupt 704, readings finished interrupt 706, and watchdog/event counter interrupt 708.

The pump or mute interrupt 702 is activated by detection of either the pump sensor or mute switch and simply updates the PUMP and MUTE flags to show pushes. This routine also counts pump pushes over time to detect a "Near Empty" condition indicated by rapid pump pushes by the user.

The communications interrupt 704 indicates a request or send requirement over the serial port such as an RS232 read which finishes by sending a readings finished interrupt 706.

The watchdog/event counter interrupt 708 is used to increment counters for motion, alarm, logging, delays, etc. . . . .

Figure 11:
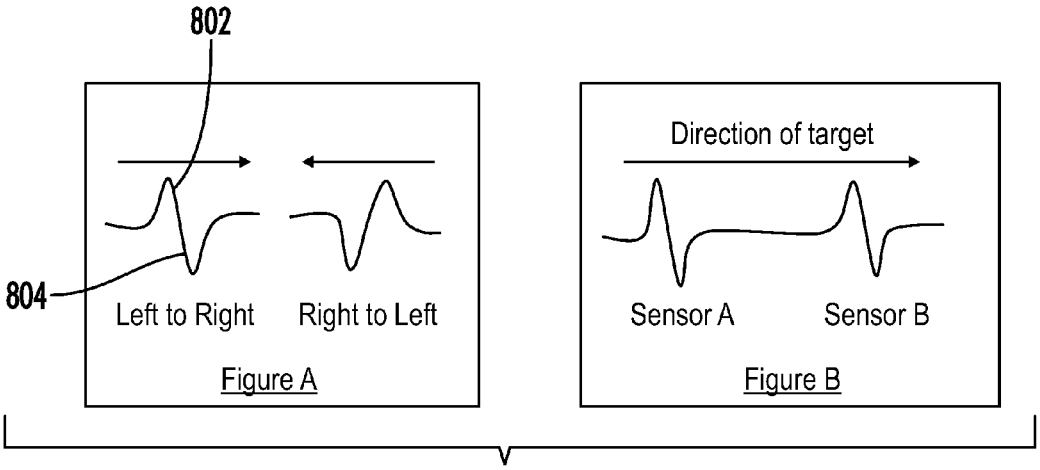
FIG. 11 is a schematic representation of sensor electrical signals.

FIG. 11 shows the PIR sensor data signals and the detection methods. A detailed description of the PIR, Passive-Infra-Red, sensors operation is relevant to the operation and selectivity and of the sanitizer sensor. The PIR sensors used are built from two thermopiles in opposition to each other. In other words, the active detectors inside the PIRs are connected (A)plus-minus to (B)minus-plus. The results of this connection are that when ambient light strikes the sensor the A and B detector both react and cancel each other to give a net output change of zero. If one detector is exposed to light the differential voltage level will cause a signal that can be detected. Because of the way the detectors inside the PIR are connected, the output signal can be used to determine which direction a target is moving in relation to the PIR sensor. FIG. 11 shows the first detection signal 800

As it can be seen in FIG. 11A, the direction of the target can be determined from a single PIR with a positive spike 802 to negative spike 804 transition indicating the direction. By using two PIR sensors, FIG. 11B, the system can be configured to greatly reduce false alarms. Setting Sensor A on the left side of Sensor B the unit can determine that the target moved from left to right. Sensor A shows left to right, Sensor B shows left to right, and finally, because the orientation of the sensors is fixed with sensor A being on the left side of sensor B the three pieces of information can be compared to determine the targets direction with very high certainty. It can be seen that if the direction of the target does not all agree with the target direction then the unit can determine that the particular event is a false alarm. This allows the unit to be very deterministic regarding target direction. With a simple modification this information could also be used to calculate the speed of the target as it moves across the field of view.

Figure 12:
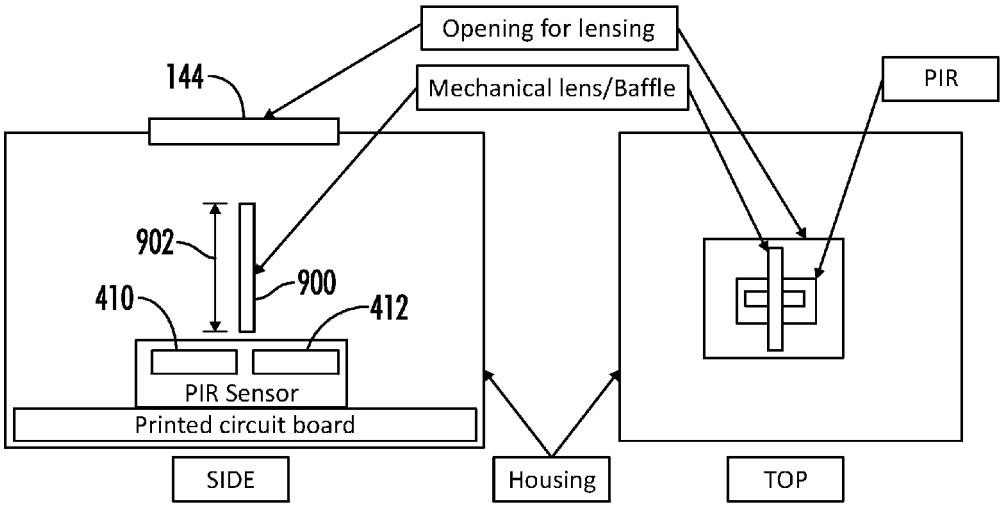
FIG. 12 is a schematic representation of the mounting of the PIR mechanical lens baffle.

As shown in FIG. 12, the PIR mechanical lens baffle 900 is a cross between a "shadow lens" and a baffle. I have referred to this as a "mechanical lens" for lack of a better term. This scheme was chosen because optics for the IR light range are made of exotic materials and relatively speaking—very expensive. The size of the housing opening 144 and the distance the sensor from the housing opening 144 restricts the visibility and sets the width of the detection envelope. The mechanical lens or baffle 900 then enhances the shadowing of a target as it passes in front of the sensor. This way the target, here people, will create a larger disturbance to the detector and allow for easier detection. This is important as the outer envelope is made smaller and the temperature difference of the targets decreases from the ambient. The frenzel lenses used in most motion detectors are not a good fit for this application because they create a very large field of view and their directionality/selectivity is very poor. This difference is important in false alarm prevention and aiming of the detectors so only movement into and out of the room are detected. This lensing scheme allows for a narrow field of view and excellent performance and noise rejection. The height 902 of the mechanical lens can also be adjusted to modify the performance and field of view.

Lensing

Controlling the field of view of the device is critical to preventing false alarms and allowing alarming in a predictable and desired way. IR optics are expensive and require the use of exotic materials. To reduce costs, weight and complexity this device uses mechanical lensing to control the field of view in two ways.

First, the two PIR sensors 410, 412 are within the device body 100 and the hole 144 to the outside helps to fix the field of view. The second very important feature is a set of metal baffles 900 or shields that are thin and secured perpendicular above the PIR devices. These are located right between the two sections 410, 412 of the thermopile to separate each PIR sensor. These metal shields, whose length and height are important, enhance the separation of the target signal and greatly affect (reduce and aim) the field of view. The 'taller' the shields the more directional the system becomes (narrowing the field of view). There are practical limits of how directional the system can be. If the shields get too tall then it will create more errors (missed targets). Understanding the sources of error are important for sizing the baffle 900.

Sources of Error

The PIR is a passive device and as a result there are many factors that affect the shape of the wave forms used for target detection. Speed, Distance, Ambient temperature, Target temperature (relative to background) to name a few. The main point of the following paragraphs is to illustrate that the PIR sensors have limitations in their performance and there can and will be false positives and missed detections. The goal is to adjust the detectors field of view to minimize these anomalies as well as to avoid problems by not installing the detectors in areas where they will not perform well.

Speed: Speed of the target will decrease the width of the pulses. Both positive and negative and basically squeeze the signal together. This can make the reading harder to capture since the PIR can only react so fast. Any event that happens too fast will cause the PIR to output a signal that is not what would be typically expected or it could be missed entirely.

Distance: The distance of the target to the PIR greatly affects the signal level and the ability to distinguish a signal from the background. Signal strength decreases with range by the inverse square law. Signal Strength=1/distance$^2$ Ambient Temperature: The higher the ambient temperature the lower the signal level will be for a human target as they move through the PIR field of view. The signal level is directly proportional to the temperature differential. This will manifest itself as a reduction in sensing range and the ability to detect targets. Faster moving targets will also be harder to detect.

Target Temperature: Because the sensor depends on the temperature difference between the target (person) and the room temperature a hotter person will generate a larger signal while a cooler person will generate a smaller signal. Individuals wearing short sleeves vs. winter coats will have vastly different signal levels. People walking in from the cold or wearing heavy clothing will be hard to detect and may be missed altogether. Because of the tall field of view, typically the persons head will be enough of a heat source to allow for proper detection.

This system could also be used as a people counter for banks, libraries or any other locations. It has the advantages of not needing a reflective surface or light source on an opposite wall. It also tracks direction so by counting the number of people entering and exiting a location the value can be divided by two to get the total customer count. This could reduce errors if customers entering or leaving in groups are too close to detect individually.

The following settings & adjustments are provided as an indication of the values associated with the prototype unit constructed although these may vary with different component or processor selections.

PIR Stability, Sensitivity and Speed Adjustments
ARRAY_DEPTH=150
Number of PIR reads to average for results
ALARM_COUNT_LIMIT=4
Number of times each alarm needs to be active
ALARM_TIMEOUT=20
How long 1 channel can be in alarm before the other needs to be
TARGET_SIZE=4
Number of consecutive "alarm_count_x" readings need to trigger alarm 1 or 2
TARGET_OFFSET=2
Value if average that must be exceeded to trigger alarm
PUMP_EMPTY=6
Limit for # of times the pump is pushed during wait to determine if sanitizer is empty
BACK_UP_DELAY=417
Timer to auto-back-up stats. 12 hrs=43200 sec, 43200/1.578 msec=27,376,425.86, 27,376,425.86/65535=417.7
Pushing MUTE button also causes data to be saved to flash memory
Low Battery Voltage Threshold
BATTERY_VOLTAGE_LIMIT=512
1.5 v/1024=1.464844 mV; 0.75 v/1.464844 mV=512,
To reset Battery alarm voltage must exceed BATTERY_VOLTAGE_LIMIT+100 mV
Audible Alarm Thresholds for Unit Mounted Either Inside or Outside of Room
19011*1.578 msec=30 seconds
15843*1.578 msec=25 seconds
12674*1.578 msec=20 seconds
9506*1.578 msec=15 seconds
6337*1.578 msec=10 seconds
5703*1.578 msec=9 seconds
5070*1.578 msec=8 seconds
4436*1.578 msec=7 seconds
3371*1.578 msec=6 seconds
3169*1.578 msec=5 seconds
2535*1.578 msec=4 seconds
1685*1.578 msec=3 seconds
1124*1.578 msec=2 seconds
562*1.578 msec=1 seconds
DELAY_STARTUP=12674
Delay to sound alarm on startup (~20 sec)
DELAY_ENTER=6337
Delay to sound alarm when ENTERING room (~10 sec)
DELAY_LEAVE=562
Delay to sound alarm when LEAVING room (~0 sec)
DELAY_MUTE=19011
Delay to sound alarm after MUTE pushed (~30 sec)
DELAY_PUMP=6337
Delay to sound alarm after PUSHED pushed (~10 sec)
DELAY_OFF_ENTER=6337
Audible alarm time-out after entering (~10 sec)
DELAY_OFF_LEAVE=6337
Audible alarm time-out after leaving (~10 sec)
TARGET_SEPARATION=35
How many reads to wait between channels triggering to call it valid (35)
Alarm Frequencies
FREQUENCY_A=1776
~2.87 KHz Walk IN to room alarm (freq.=5.15 MHz/TACCR0)
FREQUENCY_B=2575
~2 KHz Walk OUT of room alarm (freq.=5.15 MHz/TACCR0)
FREQUENCY_STANDARD=2060
~2.5 KHz Frequency used for everything else (freq.=5.15 MHz/TACCR0)

REFERENCE NUMERALS USED THROUGHOUT THE DETAILED DESCRIPTION AND THE DRAWINGS CORRESPOND TO THE FOLLOWING ELEMENTS

Pump bottle 10
User activated dispensing pump 12
Hand sanitizer unit 100
Main body 110
Top 120
Top Mounting aperture 122
Bottom 130
Bottom Mounting aperture 132
First side 140
Sensor recess 142
sensor aperture 144
Second side 150
communications aperture 152
Front 160
Button aperture 162
Mute button 164
Back 170
Circuit aperture 172
Pump sensor cord 200
Pump sensor 202
Electrical circuitry 300
Battery pack 302
Pump circuit board 304
Detection circuit board 306
Circuit schematic 400
Microprocessor 402
Mute control switch 404
Alarm 406
Motion sensor 408
First infrared sensor 410
First AD converter 411
Second infrared sensor 412
Second AD converter 413
Power supply 414
Communication port 416
Pump sensor 418
RF transceiver 420
Serial port 422
Power switch 424
Direction of motion switch 426
Communication system 428
Microphone input 430
Voice chip 432

Speaker 434
Power on flow chart 500
Chirp 502
Initialize variables 504
Await steady state 506
Initialize log data 508
Enter main loop 510
Main loop 600
Read analog to digital converters 602
compute PIR value 604
Determine movement 606
Compute battery life 608
Housekeeping 610
Log data 612
Display data 614
Alarm on Off 616
Check serial port 618
Interrupt routines 700
Pump or mute interrupt 702
Communications interrupt 704
Readings finished interrupt 706
Event counter interrupt 708
First detection signal 800
Positive spike 802
Negative spike 804
PIR lens 900

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining, ' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A hand sanitizer apparatus for use with a pump bottle using a user activated dispensing pump, the invention comprising:

a main body defining a sensor aperture;

a first infrared sensor positioned to sense movement through the sensor aperture;

a second infrared sensor positioned to sense movement through the sensor aperture;

a mechanical lens baffle positioned between and perpendicular to the first and second infrared sensor;

a microprocessor electrically connected to the first infrared sensor and second infrared sensor;

a pump sensor positioned at the user activated dispensing pump, the pump sensor connected to the microprocessor; and an alarm connected to the microprocessor, wherein the alarm is sounded when motion is detected and the pump sensor does not detect activation of the user activated dispensing pump.

2. The apparatus of claim 1 further comprising:
a mute control switch connected to the microprocessor.

3. The apparatus of claim 1 further comprising:
communication system connected to the microprocessor.

4. The apparatus of claim 1 further comprising:
a direction of motion switch connected to the microprocessor.

* * * * *